United States Patent [19]

Augustine

[11] 4,233,587

[45] Nov. 11, 1980

[54] ELECTRIC BRAKING SYSTEM

[75] Inventor: Robert F. Augustine, Greendale, Wis.

[73] Assignee: Kelsey Hayes Co., Romulus, Mich.

[21] Appl. No.: 937,009

[22] Filed: Aug. 25, 1978

[51] Int. Cl.[3] ..... H01C 10/16

[52] U.S. Cl. ..... 338/96; 338/108; 338/153

[58] Field of Search ..... 338/96, 108, 39, 153, 338/155; 303/3, 15, 20

[56] References Cited

U.S. PATENT DOCUMENTS

| | | | |
|---|---|---|---|
| 3,524,159 | 8/1970 | Kilbourn | 338/96 X |
| 3,740,691 | 6/1973 | Brown | 338/39 |
| 3,838,888 | 10/1974 | Gynn | 338/108 X |

*Primary Examiner*—C. L. Albritton

*Attorney, Agent, or Firm*—Ralph J. Skinkiss; William P. Hickey

[57] ABSTRACT

A variable resistance controller for electrical braking systems and the like wherein the form on which the resistance wire is wound has spaced apart flats into which some of the coils are drawn during winding. This arrangement provides alternate lands and depressions over which a leaf spring type contact rolls. The preferred arrangement has only two coils per land to give increased contact pressure of the leaf spring therewith and to provide predetermined incremental increases in electrical output as the leaf spring rolls from one land to the other. In the preferred embodiment, the spacing of the lands is arranged so that the electrical output is proportional to the hydraulic actuating pressure.

The preferred embodiment also includes a diode connected between the output of the controller and ground through a fusible link to permit the collapsing magnetic field of the controlled braking electromagnets to draw current through the diode on deactuation of the unit to bypass the wound resistor. This reduces arcing and increases service life.

18 Claims, 3 Drawing Figures

ELECTRIC BRAKING SYSTEM

BACKGROUND OF THE INVENTION

Electrical braking systems of the type having electromagnetically actuated brakes on a trailing vehicle controlled by a cylindrically wound resistor having a yieldable contact member which rolls over the coils of the resistor have been known for over twenty years. Such systems are relatively inexpensive, and have been made in sizable quantities; but the service life of such units has not increased appreciably over the years. A build up of dirt and corrosion of the coils and contact strip causes the electrical output of the unit to decrease with service. Another problem that has existed with such units is that the geometry of the yieldable contact member across the wound resistor inherently produces an electrical output that is not a replica of the force applied by the operator. Another problem that has existed with such units is that irregularities of the core of the wound resistor causes nonuniform contact pressure of the rolling contact to in turn cause arcing with some of the windings thereby further shortening the life of the unit.

An object of the present invention, therefore, is the provision of a new and improved helically wound electrical control unit for electromagnetically actuated brake systems and the like, which will produce a positive incrementally increasing output as the contact strip rolls across the windings and so that contact is assured with specific predetermined ones of the winding.

Another object of the present invention is the provision of a new and improved unit of the above described type in which arcing is reduced between the contact and the windings of the resistor.

Another object of the present invention is the provision of a new and improved unit of the above described type whose electrical output is predetermined by plateaus and depressions on the surface of the insulator member over which the resistance wire is wound, so that the electrical output of the unit can be positively adjusted by changing the spacing between the plateaus.

A still further object of the present invention is the provision of a new and improved braking system of the above described type wherein a bright light will appear on initial actuation if an open circuit exists to the towed vehicle. If, on the other hand, a proper connection to the trailer brakes exists, the light will be turned on in incremental stages as the electrical output of the controller increases.

Further objects and advantages of the invention will become apparent to those skilled in the art to which the invention relates from the following description of the preferred embodiments described with reference to the accompanying drawings forming a part of this specification.

DESCRIPTION OF THE PREFERRED EMBODIMENTS

Although the invention may be otherwise embodied, it is herein shown and described as embodied in a braking system having electromagnetically actuated brakes that are controlled by the flow of current from a spirally wound variable resistor. As previously indicated, it is an object of the present invention to provide a helically wound resistor which will give small incremental increases in electrical output—which incremental increases can be designed to match the actuating pressure on the controller.

Figure 1:
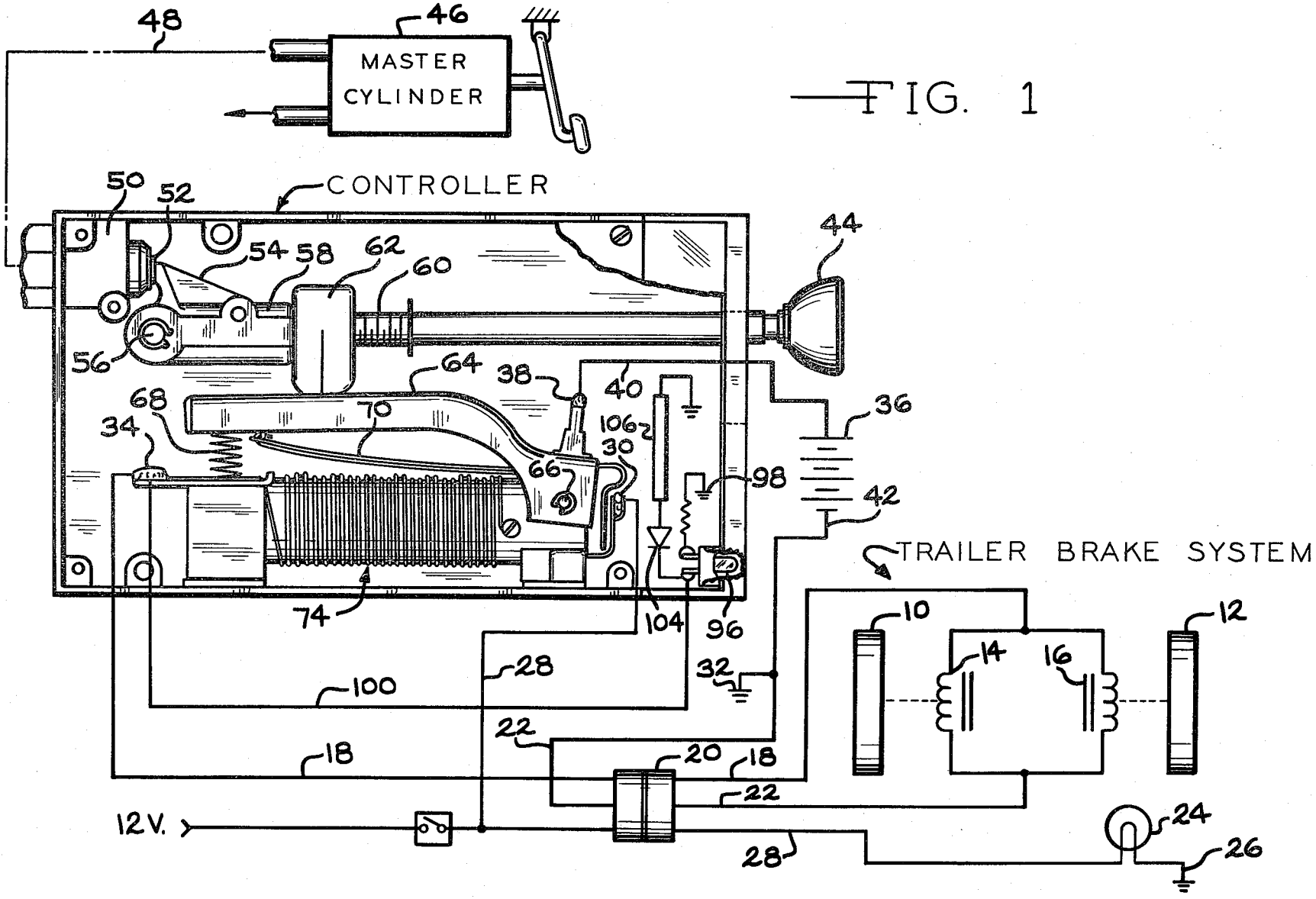
FIG. 1 is a schematic side view of an electromagnetically actuated braking system showing a preferred embodiment of controller connected to the other principal parts of the system.
Figure 2:
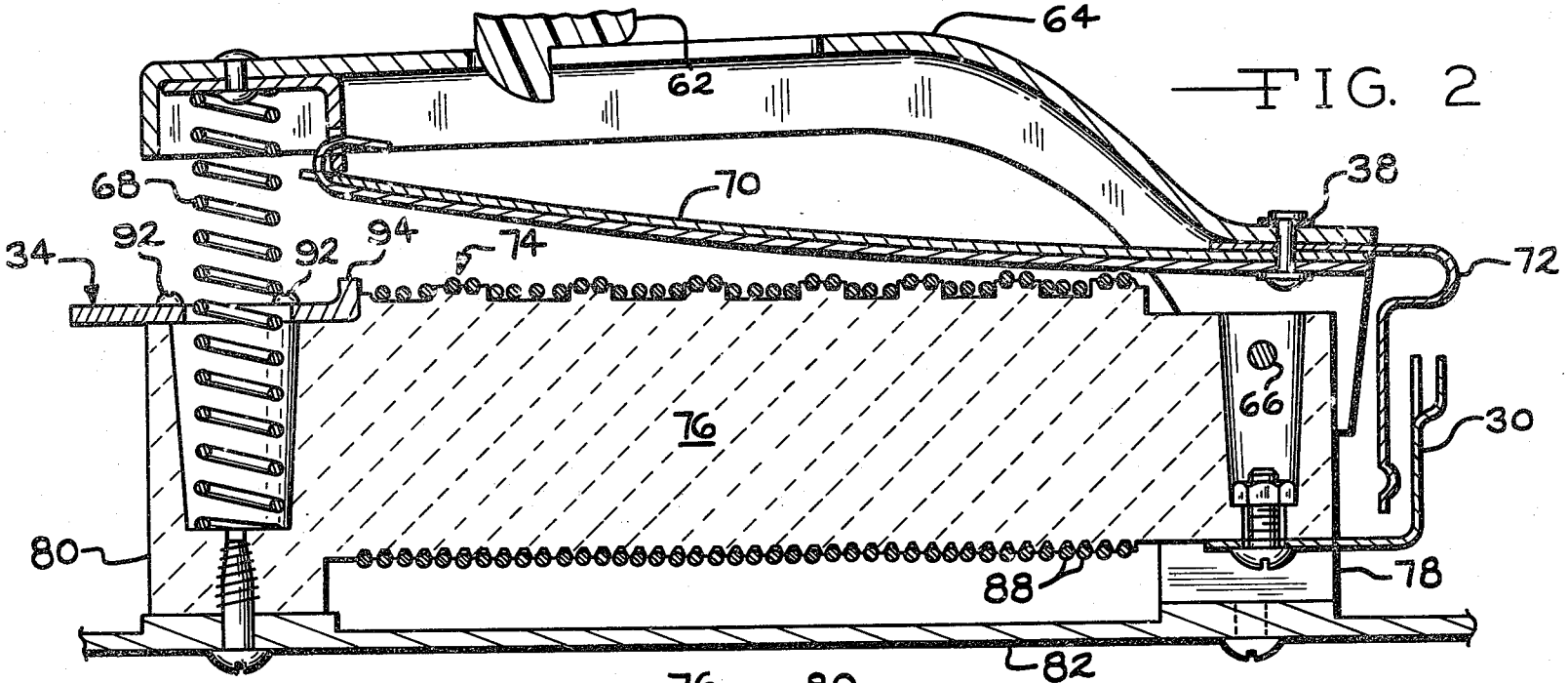
FIG. 2 is a fragmentary sectional view of the controller taken approximately on the vertical centerline of the controller.

The braking system shown in FIG. 1, generally comprises: a pair of drum brakes 10 and 12 on a trailing vehicle which in turn are actuated by electromagnets 14 and 16, respectively. The electromagnets 14 and 16 are supplied with a moldulated current supply through electrical conductor 18 and a connector 20 that is suitably positioned between the pulling and trailing vehicle. The electromagnets 14 and 16 are grounded through electrical conductor 22 and connector 20. The tail light of the trailing vehicle is indicated schematically at 24, and one side of its filament is connected to ground as at 26, and the other side of the filament is connected by electrical conductor 28 to connector 20. The electrical conductor 28 continues from the connector 20 to a stop light switch terminal 30 of the controller about to be described; the grounding conductor 22 for the electromagnets 14 and 16 extends from the connector 20 to a ground 32 on the pulling vehicle; and the power supply conductor 18 extends from the connector 20 to the power output terminal 34 of the controller. The stop light circuit can also be energized through the stop light switch as shown, independent of the brake controller. A 12-volt power supply that is obtained from the battery 36 of the pulling vehicle is connected to the electrical input terminal 38 of the controller through conductor 40. The other side of the battery is connected to ground 32 through electrical conductor 42.

The controller shown in FIG. 1 is adapted to be actuated by the driver of the pulling vehicle, either directly by the handle 44, or hydraulically from the hydraulic braking system of the pulling vehicle. The output line 48 of the master cylinder 46 is connected to a small hydraulic actuating cylinder 50 that is part of the controller. The piston 52 of the hydraulic cylinder 50 abuts one leg of an L-shaped actuating lever 54 that is suitably pivoted at its center 56, so that its other horizontal leg 58 moves vertically. The handle 44 has its inner end retained within the leg 58 in a manner permitting rotation of the lever 44. The lever 44 has external threads 60 thereon which are threaded through an abutment member 62 to cause the abutment member 62 to move longitudinally of the handle 44 when the handle is rotated. The lower end of the abutment member 62 bears against the midsection of a contact arm 64 that is suitably pivoted about a horizontal axis 66 at one end, and which is biased upwardly against the abutment member 62 by a coil spring 68 located at its other end. The bottom side of the contact arm 64 carries a leaf spring assembly 70 made of electrically conducted material and which is fixed to the arm 64 at one end by the electrical input terminal 38, and which is hooked onto the bottom of the contact arm 64 at its other end. The rivet portion of the electrical input terminal 38 is also connected to an L-shaped contact which extends to the other side of the axis 66 for engagement with the stop light switch terminal 30 during the initial actuating movement of the contact arm 64. The portion of the braking system and controller so far described is part of the prior art; and for further details, reference may be had to U.S. Pat. No. 3,328,739.

Figure 3:
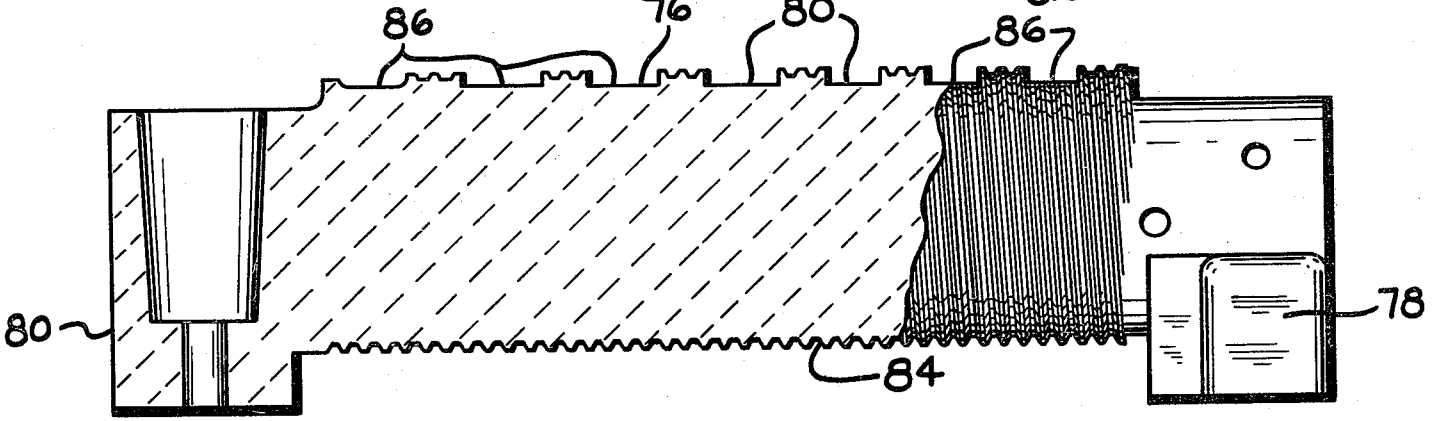
FIG. 3 is a side view of the insulator core shown in FIGS. 1 and 2.

According to principles of the present invention, the leaf spring assembly 70 when actuated rolls across a wound resistor of a new and improved design to accomplish a number of the objects heretofore enumerated. The wound resistor 74 comprises an insulator core that is pressed from asbestos filled cement, or is otherwise fabricated from some nonelectrically conductive material into the shape shown in FIG. 3 of the drawings. The insulator core has opposite end legs 78 and 80 for supporting the core up off of the housing 82 of the controller, and a generally cylindrical center portion which has a spiral groove 84 running lengthwise thereof. The top portion of the insulator core 76 has spaced apart flats 86 milled, or otherwise formed therein, to a depth beneath the bottom of the spiral groove 84. A resistance wire 88 is wound tightly in the spiral groove 84 so that those portions of the resistance wire 88 which pass through the flats 86 are pulled beneath the plane of the coils that are completely supported in the spiral groove 84. The flats 86 may be of any desired width and spacing, but in the embodiments shown in the drawings, are spaced to provide two cylindrical coils fully supported between the flats 86. The width of the flats 86 are designed to provide increments of resistance starting adjacent the input terminal 38, such that when the leaf spring 70 is forced down on top of the fully supported coils, the current flow from the input terminal 38 to the output terminal 34 will increase at a rate that is generally proportional to the hydraulic actuating pressure of the master cylinder 46. To my knowledge there has been no way, prior to the present invention, that a leaf spring rolling over a spirally wound resistor would give a predictable output current that is proportional to the actuating pressure.

Additionally, it will be seen that the bearing contact of the leaf spring 70 with the resistance wire occurs on no more than two adjacent coils at spaced apart locations. This is an advance over the prior art in that the bearing pressure is increased, and the problem of arcing with respect to the wound resistor is greatly reduced. It will be understood that prior art production molded parts have surface irregularities therein which cause contact by the leaf spring 70 to be light and "hit or miss" causing arcing therebetween. In the embodiment of the present invention, however, the coils seated in the flats 86 are sufficiently out of contact with the leaf spring 70 that they never arc, and contact with the two coils between each flat 86 is always firm to greatly reduce arcing. It will now be seen that the width and location of the flats 86 can be designed to give any desired incremental increase in electrical output and that the electrical output of the controller can be designed to match any desired curve. The input end of the resistance wire is anchored by the self tapping screw 90. The output terminal 34 shown in the drawing is generally L-shaped, and is supported on the insulator by means of a pair of self-tapping screws 92. The upstanding leg 94 of the output terminal 34 is positioned beneath the end of the leaf spring 70 for direct contact therewith for full output voltage.

Also according to principles of the present invention, a light emitting diode 96 is connected between ground 98 and the output terminal 34 by electrical conductor 100. It will be understood that the electromagnets 14 and 16, when connected to the output terminal 34 provide a sufficiently low resistance to ground that the initial contact of the leaf spring 70 with the resistance wire 88 causes the LED 96 to be dimly lit. If, however, a connection is not provided by the connector 20, or a broken wire exists, there will be a very little current flow through the resistance wire 88 on initial contact and substantially full voltage will be supplied to the LED 96 causing it to burn brightly. A very definite indication, therefore, is given the operator on the initial actuation that the trailer brakes are being energized. As the contact 70 rolls along the lands 102 between the flats 86, there will be abrupt increases in intensity of the light provided by the LED 96. If the spring leaf 70 were to make sequential contact with all of the coils of the resistance wire, the incremental increase in the light emitted by the LED 96 may be so gradual as to not be readily apparent. A definite advantage, therefore, occurs with the combination of the LED and the stepped core design of the present invention.

According to further principles of the present invention, a diode 104 and fusible link 106 are connected in series between the power output terminal 34 and ground. The diode 104 is installed to prevent electrical flow from the output 34 to ground during normal actuation. However, upon deactuation of the braking system, the collapse of the field in the electromagnets 14 and 16 builds a voltage in a direction to keep the current flowing from the output 34, and the diode 104 is arranged to allow this flow to take place bypassing the wound resistor 74. I have found that arcing between the leaf spring 70 and the resistance wire 88 occurs more during deactuation, than it does during actuation; and that the diode 104 so arranged eliminates the major portion of the arcing problem. The fusible link 106 is provided as a fail safe mechanism to prevent shorting out of the diode 104 from disabling the braking system. Should the diode 104 short out, the fusible link 106 will in turn burn out to prevent the output terminal 34 of the controller from being grounded out.

Reliability tests which have been made on the brake controller of the present invention having the stepped resistor 74, the LED 96, the diode 104, and the fusible link 106 show that the service life of the units are approximately twice those of a prior art unit having a standard cylindrical wound resistor and without the LED, the diode, and fusible link. What is more, the average deviation in electrical output of the units of the present invention as manufactured, was considerably less than the prior art units. In addition, the change in electrical output with service was much less than occurred with the prior art units. The stepped wound resistor of the present invention therefore not only gives an electrical output that is more nearly proportional to the hydraulic output of the actuating hydraulic system, but its reliability and service life is much greater than the prior art controllers.

Whiie the invention has been described in considerable detail, I do not wish to be limited to the particular embodiments shown and described, and it is my intention to cover hereby all novel adaptations, modifications, and arrangements thereof which come within the practice of those skilled in the art to which the invention relates, and which fall within the purview of the following claims.

I claim:

1. A controller for an electric braking system and the like comprising: a longitudinally extending electrical resistor element having an electrically conductive surface, a longitudinally extending contact element supported for initial contact at one end of said electrically conductive surface and for progressive contact thereafter along the electrically conductive surface toward the other end, first electrical terminal means connected to said longitudinally extending contact and second electrical terminal means connected to said other end of said electrical resistor element, said electrically conductive surface having alternate plateaus and valleys which cause said contact element to successively engage the plateau areas of said electrically conductive surface and bridge across said valleys.

2. The controller of claim 1 including a light emitting device connected between said other end of said resistor element and ground.

3. A controller for an electric braking system and the like comprising: a generally cylindrical insulator core having spaced apart transversely extending depressions with plateaus therebetween arranged generally longitudinally of its surface, a circumferentially wound electrical conducting wire over the generally cylindrical surface of said insulator with coils alternately passing over said plateaus and depressions and with the coils overlying said depressions being radially beneath those passing over said plateaus, a longitudinally extending contact element supported for successive contact with the coils on successive plateaus starting adjacent one end and proceeding to the other end, a power supply terminal for said contact element, a power outlet terminal on said other end of said circumferential electrical conducting wire, and actuating means for causing said contact element to successively contact the coils of successive plateaus.

4. A controller for an electric braking system and the like comprising: a longitudinally extending electrical resistor element, a longitudinally extending contact element supported for initial contact at one end of said resistor element and thereafter for progressive contact along the resistor element toward the other end, first electrical terminal means connected to said longitudinally extending contact element and second electrical terminal means connected to said other end of said electrical resistor element, and a diode connected between said other end of said resistor element and ground.

5. The controller of claim 4 including fuse means in series with said diode, said fuse means being arranged to open the circuit on shorting out of said diode.

6. A controller for an electric braking system and the like comprising: a circumferentially wire wound resistance element having a generally cylindrical insulator over which said resistance wire is coiled, said insulator having spaced apart depressions with plateaus therebetween and said resistance wire being wound over successive plateaus and depressions with coils in said depressions being positioned radially inwardly of the coils on said plateaus, a longitudinally extending contact element supported for initial contact at one end and for progressive contact thereafter with successive plateaus spaced along the resistor element toward the other end, first electrical terminal means connected to said longitudinally extending contact and second electrical terminal means connected to said other end of said electrical resistor element, and whereby said contact element successively engages the coils on one plateau after another.

7. The device of claim 6 having at least one and no more than three coils of the resistor element on each plateau.

8. A controller for an electric braking system and the like comprising: a generally cylindrical insulator core having spaced apart transversely extending depressions with plateaus therebetween arranged generally longitudinally of its surface, a circumferentially wound electrical conducting wire over the generally cylindrical surface of said insulator with coils alternately passing over said plateaus and depressions and with the coils overlying said depressions being radially beneath those passing over said plateaus, there being at least one and no more than three coils on successive plateaus, and a longitudinally extending contact element supported for successive contact with the coils on successive plateaus starting adjacent one end and proceeding to the other end.

9. The controller of claim 8 having only two coils on successive plateaus.

10. The controller of claim 8 having unidirectional current flow means connected in series between said power outlet terminal and ground, and arranged to permit current flow of the same polarity as is supplied said power terminal to flow to said power outlet terminal.

11. The controller of claim 10 including overload protection means in series with said unidirectional current flow means and arranged to open the series circuit upon shorting out of said overload protection means.

12. The controller of claim 11 including a light emitting device connected between said power outlet terminal and ground.

13. The controller of claim 8 having unidirectional current flow means connected in parallel between said power outlet terminal and ground and arranged to permit current of the same polarity as is supplied said power terminal to flow to said power outlet terminal, overload protection means in series with said unidirectional current flow means and arranged to open the series circuit upon shorting out of said unidirectional current control device, and a light emitting device connected between said power outlet terminal and ground.

14. The controller of claim 13 wherein said unidirectional current flow means is a diode, said light emitting device is a light emitting diode; and said overload protection means is a fusible link.

15. An electric braking system for a vehicle towed behind a control vehicle comprising: brake means on said towed vehicle actuated by an electromagnet; variable resistance means on said control vehicle and having a power input terminal, a power outlet terminal and means for varying electrical current flow from said input terminal to said power outlet terminal; an electrical connection from said power outlet terminal to said electromagnet of said towed vehicle; a diode connected in parallel circuit between said power outlet terminal and ground; and a fusible link in series with said diode arranged to open, should a short circuit develop across said diode.

16. The braking system of claim 15 including a light emitting diode connected between said power outlet terminal and ground.

17. In a controller for electric braking systems and the like of the type having a wound resistor element providing successive coils against which a contact element makes successive contact when actuated, the improvement comprising: a longitudinally extending electrical insulator form for supporting said coils on its exterior surface, said insulator form having a longitudinally extending portion of its external surface having alternate plateaus and valleys, said valleys supporting coils of the wound resistor element thereon beneath the level of coils supported on said plateaus, and whereby the contact element passes over the coils in the valleys.

18. A method of causing the output characteristics of a wound variable resistor to match a desired output curve, comprising: providing an electrical insulator form with spaced apart valleys in its surface for supporting coils of the wound resistor below the level of the coils on the remainder of the variable resistor, and designing the width of the valleys so that the increase in electrical output when the contact moves between coils on opposite sides of a valley corresponds to the increase in output of the desired output curve.

* * * * *